United States Patent [19]

Goens et al.

[11] 3,972,795

[45] Aug. 3, 1976

[54] AXIAL FLOW ELECTROLYTIC CELL

[75] Inventors: Duane N. Goens, Golden, Colo.; James L. Lake, Lakewood, Ohio

[73] Assignee: Hazen Research, Inc., Golden, Colo.

[22] Filed: Sept. 11, 1974

[21] Appl. No.: 505,029

[52] U.S. Cl. ..... 204/269; 204/270; 204/275; 204/284

[51] Int. Cl.[2] ..... C25C 3/08; C25C 7/00

[58] Field of Search ..... 204/267, 269, 275, 284, 204/290 F, 149, 152, 153, 278, 270

[56] References Cited

UNITED STATES PATENTS

| | | | |
|---|---|---|---|
| 756,328 | 4/1904 | Christy | 204/275 X |
| 3,701,724 | 10/1972 | Entwisle et al. | 204/290 F |
| 3,778,307 | 12/1973 | Beer | 204/290 F X |

*Primary Examiner*—John H. Mack
*Assistant Examiner*—A. C. Prescott
*Attorney, Agent, or Firm*—Sheridan, Ross & Fields

[57] ABSTRACT

There is provided a membrane-free axial flow electrolytic cell in which the anodes and cathodes are perforated and lie transversely of a conduit through which an ion containing and conducting medium is pumped. This device is especially useful in the electrolytic recovery of metal values from acid leach solutions from low grade ores, e.g., copper, and for the carrying out of electrochemical reactions such as the production of sodium hypochlorite or sodium chlorate from NaCl.

16 Claims, 8 Drawing Figures

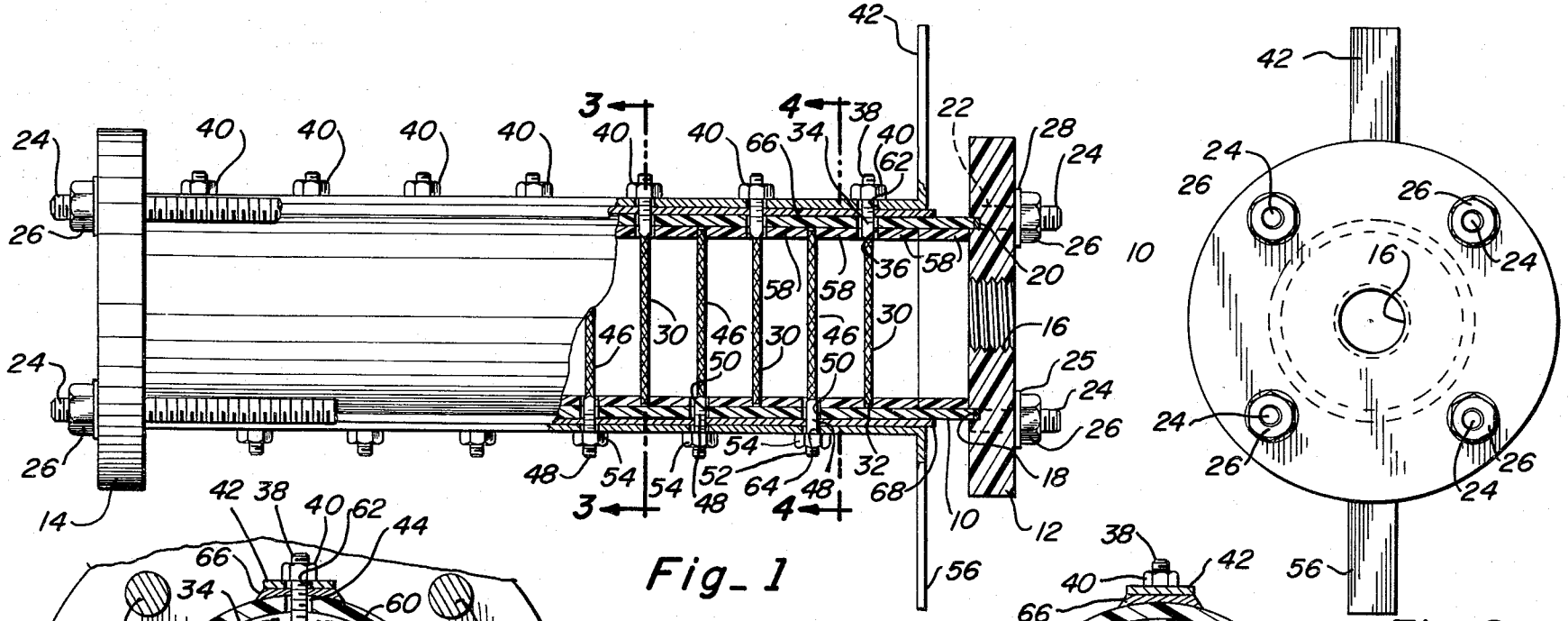
Fig. 1
Fig. 2
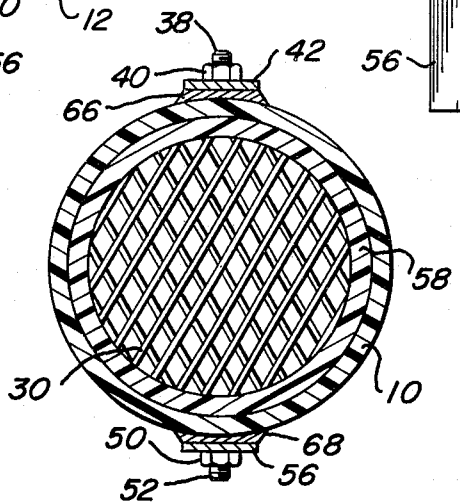
Fig. 4
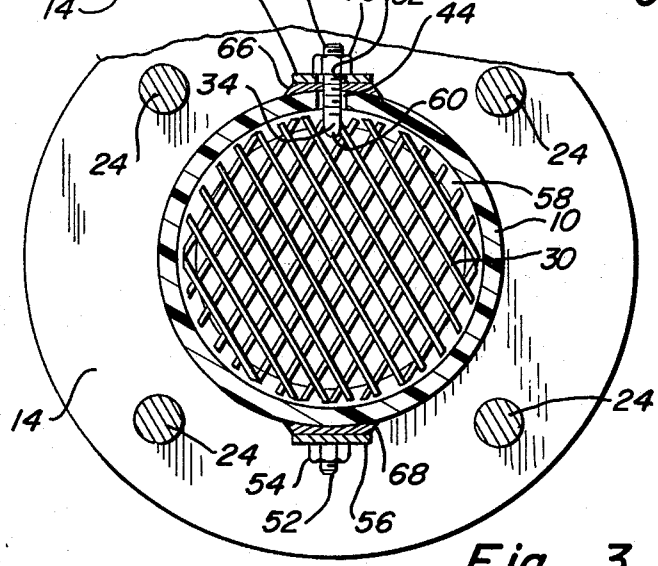
Fig. 3

AXIAL FLOW ELECTROLYTIC CELL

BACKGROUND OF THE INVENTION AND PRIOR ART

Electrolytic refining and recovery of metal values from leach solutions is well known. The principal activity in this area has been, however, in the better grades of ore. Where the primary metal to be recovered is in too low concentration, e.g., in the case of copper less than about 0.5 percent by weight, it is uneconomical to recover the copper and such ore is frequently passed over as worthless. Too much material must be handled for current prices to justify the effort. The prior art has reported it to be all but impossible to extract the last of the copper electrolytically at a profit. (See U.S. Pat. No. 1,195,616, Column 3, Line 28).

Ordinarily in electroplating by electrolysis, the manufacture of the chlorine by electrolysis, and such other electrochemical reactions it is desirable to have maximum current density for the most rapid exchange of electrons and hence electrochemical reaction. However, the intensity of the current used or the current density is directly proportional to the concentration of, for example, the metal being recovered from the ion containing and conducting medium. As the ion containing and conducting medium is depleted of the metal being plated, for example, the efficiency of the cell decreases rapidly. It has, therefore, been common practice to use a given cell at maximum current density until a predetermined concentration of the desired ion has been reached or efficiency has materially decreased, and then transfer the partially spent ion containing and conducting medium to another cell where a lower current density is being applied. Alternatively, the current density in a cell such as that first described may be manually adjusted as the desired metal ion is depleted from the ion containing and conducting medium so as to correspond more nearly to the strength of that medium. This is impractical. Thus, it has been common practice to utilize a series of individual cells using decreasing current densities in succeeding cells until the ion being recovered is finally depleted at the end of the series of cells.

The present invention solves these problems by providing an apparatus in which the current drain automatically decreases in an axial direction as the concentration of the desired ion in the ion containing and conducting medium also decreases. In like manner where an electrochemical reaction is being carried out as the concentration of a desired product increases, and the demand for conversion of the raw material decreases, also the current drain will automatically decrease. This improves the efficiency of the overall cell.

Also, the axial flow type cell of the present invention enables efficient recovery of low concentrations of desired ions from the ion containing and conducting medium which concentrations were prior to this time thought to be uneconomically recoverable. The improved cells of the present invention have the advantage in that a single cell utilizing an axial flow principle for the ion containing and conducting medium replaces the multiple cell procedure previously described, as well as those where the electrolyte followed a tortuous path between and around a stack of electrodes.

BRIEF STATEMENT OF THE INVENTION

Briefly stated, the present invention is in an axial flow electrolytic cell which comprises in combination an electrically non-conductive tubular conduit having end closures for each end of the conduit, and each of the end closures having an opening therethrough for passage of an ion containing and conducting medium. A plurality of electrodes is provided in axially spaced relation within the conduit and transversly disposed across the conduit, each of the electrodes being provided with macro openings extending therethrough. First bus bar means are provided which electrically connect alternate ones of the electrodes. Second bus bar means isolated from the first bus bar means also are provided for electrically connecting the remaining electrodes. When fluid is pumped through the tubular device and the alternate electrodes are connected to opposite poles of a source of direct current, rapid flow of the ion containing and conducting medium through the apparatus with minimum pressure drop may be achieved and quite surprisingly, in such an arrangement the current drain is most heavy in the initial portion of the apparatus where the concentration of the desired ion, for example copper ion, is found, and gradually decreases in the direction of flow of the ion containing and conducting medium as the concentration of the desired ion decreases. It is believed that this phenomenon is observed because the ion containing and conducting medium is moved through all of the electrodes alternating between positively and negatively charged electrodes in the course of its axial movement. The flow is essentially turbulent flow in order to minimize the effects of build up of ion concentration adjacent the electrode surfaces which concentrations tend to reduce the efficiency of the electrode. Because of the parallel arrangement of the alternating positive and negatively charged electrodes, the control of the voltage at which the desired plate reaction occurs is relatively simple, and the current drain along the circuit becomes a function of the concentration of the desired ion in the ion containing and conducting medium.

In a more specific embodiment of this invention, there is provided an axial flow electrolytic cell in which an ion containing and conducting medium flows axially through perforated electrodes of alternating polarity at flow rates normally greater than 5 ft./minute and which comprises in combination a rigid electrically nonconducting tube of uniform circular cross section. Electrically nonconductive end closures are provided for each end of the tube, each of the enclosures having an opening therethrough preferably tapped to receive a suitable conduit for the passage of an ion containing and conducting medium into and out of the cell respectively. A plurality of circular expanded metal electrodes of one sign is provided in axially spaced relation to each other and circumferentially engaging the sidewalls of the tube, each of the electrodes of the said one sign having terminal means radially extending therefrom and projecting through the wall of the conduit. A first bus bar externally of the tube and electrically connecting all of the terminal means of the one sign is provided. Also, a plurality of circular expanded metal electrodes of the opposite signs are provided in axially spaced and alternating relation with the electrodes of the one sign. These electrodes of the opposite sign also circumferentially engage the sidewall of the tube and have terminal means radially extending therefrom and projecting through the wall of the tube. A second bus bar electrically isolated from the first bus bar and lying externally of the tube electrically connects all of the terminal means of the opposite sign.

In the further discussion of the present invention reference will be had to an "ion containing and conducting medium". This is commonly and perhaps inaccurately frequently referred to as an electrolyte. It is believed to be more correctly defined as a medium which conducts ions or allows for ion transport and a medium which also contains such ions. For example, water, neglecting for a moment the slight degree of dissociation of pure water, is an ion conducting medium. Until it contains ions of a desired nature, e.g., copper ions, it is not an ion containing and conducting medium.

Reference will also be had to the electrodes as being "macro" porous. This is to distinguish the electrodes of the present invention from the micro porous electrodes which are formed from pressed graphite or from powdered sintered metal and in which the pores are extremely fine. In the present invention the electrodes are conveniently formed of expanded metal, e.g. titanium metal, in which the minor dimension is approximately 3/16 of an inch and the major dimension is approximately 5/16 of an inch. The effective surface area of such an expanded metal electrode is nearly 80 percent of a solid plate and yet it has an open area of at least 50%. Any other perforated means may be used, e.g. drilled or punched openings through the electrode which will provide a large amount of electrode surface with minimum resistance to the flow of liquid therethrough.

BRIEF DESCRIPTION OF THE DRAWINGS

The present invention may be better understood by having reference to the annexed drawings wherein:

FIG. 1 is a side elevation, partially cut away, of an axial flow cell in accordance with the present invention.

FIG. 2 is a top plan view of the cell shown in FIG. 1, and showing the bus bar connectors radially extending from either side thereof.

FIG. 3 is a fragmentary cross sectional view of the apparatus shown in FIG. 1 as it appears in the plane indicated by the line 3—3 in FIG. 1.

FIG. 4 is a cross sectional view of the apparatus shown in FIG. 1 as it appears in the plane indicated by the line 4—4 in FIG. 1 and showing a circular expanded metal electrode circumferentially engaging the sidewalls of the conduit.

DETAILED DESCRIPTION OF THE DRAWINGS

Figure 5:
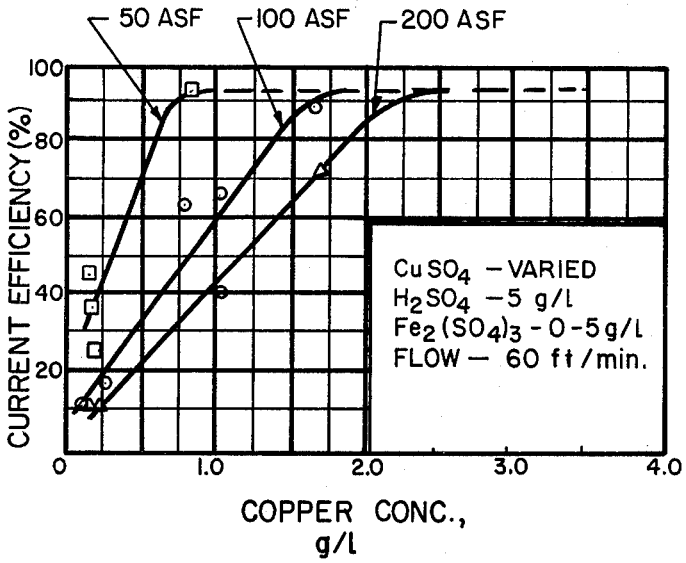
FIG. 5 is a graph showing at different current densities the relationship between current efficiency and the concentration of copper at very low concentrations of the metal.

Referring now more particularly to FIGS. 1 and 2, there is here shown a preferred embodiment of the present invention, FIG. 1 being partially cut away to show the internal construction and arrangement of the electrodes. There is thus provided a tubular conduit 10 formed of an electrically nonconducting material. Any suitable material may be used for this purpose, the most economical being a plastic material such as polyethylene, polypropylene, polystyrene, polymethylmethacrylate, or the like. Such resinous material may be transparent, transluscent or opaque so long as it serves as an electrical insulator. The conduit 10 may be of any suitable length and may under certain circumstances be flexible or formed in a spiral or circuitous path for the purpose of conserving space. For most purposes, a straight-through tubular member will be found satisfactory.

The tubular conduit 10 is provided with end closures 12 and 14, and each having openings such as the opening 16 extending through the end closure 12. This is conveniently internally threaded to receive a conduit for passage of fluid through the end closure 12. A similar drilled and tapped opening is conveniently provided in the end closure 14. Enclosure 12 is provided with a circular groove 18 dimensioned to receive one end of the conduit 10. A suitable compressible gasket 20 or seal 20 may be provided. As best shown in FIG. 2 the end closure 12 is also suitably drilled preferably at 90° intervals as at 22 to receive compression rods 24 which are conveniently threaded at each end and provide in combination with nuts 26 and washers 28 a suitable means for compressively retaining the end closures 12 and 14 in sealing engagement with the extremities of the conduit 10.

As previously indicated, the cell is provided with a plurality of transversely disposed electrodes. As shown in FIG. 1, a series of first electrodes 30 are provided at uniformly spaced intervals, these electrodes being of circular configuration as best shown in FIGS. 3 and 4 and desirably formed of expanded titanium metal. The periphery of the electrodes 30 closely approximates the internal periphery of the conduit 10, there usually being provided a slight clearance 32 for ease of assembly. Each of the electrodes 30 is provided with a radially projecting terminal member 34 which extends through the sidewall of the conduit 10 in a suitable bore 36. The outer or distal end of the terminal 34 is conveniently threaded as at 38 to receive a nut 40 useful for both the purposes of retaining the electrode 30 in proper position within the cell body 10 and for providing electrical contact with a bus bar 42. The clearance between the opening 36 and the terminal 34 is conveniently filled with a hardenable sealant 44 (FIG. 3). In the embodiment shown in FIG. 1, seven electrodes 30 are provided. Depending upon the manner in which the electrodes are ultimately connected, the electrodes 30 may be either cathodes or anodes. In like manner there are provided in alternating relationship with the electrodes 30 a plurality of second electrodes 46. The electrodes 46 are of similar design, construction and dimension to the electrodes 30. Accordingly, the electrodes 46 are provided with radially outwardly extending terminals 48 extending through bores 50 in the sidewall of the conduit 10. The distal ends of the terminals 48 are threaded as at 52 to receive retaining nuts 54 for the purpose of securing the electrodes 46 to a bus bar 56 of opposite polarity to the bus bar 42 when the cell is connected in an electric circuit not shown. As in the case of the first electrodes 30, there is provided a plurality of electrodes 46 in alternating relation with the electrodes 30. In the embodiment shown six electrodes 46 are provided. The total number of respective electrodes is immaterial insofar as the present cell structure is concerned, but seven first electrodes 30 and six second electrodes 46 has been found satisfactory.

In order to maintain the electrodes 30 in suitably spaced relationship to the electrodes 46 of opposite electrical charge there is provided a plurality of spacing collars 58 of similar axial dimension and dimensioned for close sliding fit within the internal diameter of the conduit 10. The spacing collars 58 are also formed of a nonconducting material which may be the same as or different from the nonconducting material used in fabricating the conduit 10.

It should be noted that in the preferred embodiment the spacing between the electrodes of opposite charge, e.g. electrodes 30 and 46, is uniform throughout the axial length of the cell. Prior art structures have sought to improve cell efficiency by varying the distance between the electrodes in order to accommodate various concentrations of the desired ion. This is not necessary in the present structure and therefore renders more simple and less expensive the construction of the device.

In like manner the terminals 48 are suitably sealed against escape of liquid through the bores 50. The terminals such as terminals 34, are suitably secured to the expanded metal electrodes, e.g. electrodes 30, by welding or soldering as at 60 in order to ensure adequate electrical connection. As indicated above, alternate electrodes 30 and 46 extend through opposite sides of the cell defined by conduit 10. The terminals 34 and 48 also extend through bores 62 and 64 in bus bars 42 and 56, respectively. The bus bars 42 and 56 in the embodiment shown in the drawings, lie along opposite sides of the conduit 10 and are out of electrical contact with each other. These are conveniently cemented as by hardening cement strips 66 and 68 respectively to the external surface of the conduit 10.

The laterally extending portions of the bus bars 42 and 56 may be secured by any suitable means not shown to the opposite poles of a source of direct current.

In operation, an ion containing and conducting material containing for example copper ions in solution, is introduced to the cell through the end plate 12 and a suitable conduit threadedly engaged in the threaded bore 16. This material is pumped quite rapidly (at velocities normally greater than 5 ft./minute) in an axial direction through the perforated electrodes 30 and 46. Where the concentration of the copper ion is at its highest adjacent the end cap 12, the demand for electrical current generated by the electrodes 30 and 46 first encountered will be at the highest. As the ion containing and conducting medium passes through the cell and the copper ion concentration is decreased by the formation of suspended particles of metallic copper, the current demand called for by adjacent electrodes 30 and 46 also decreases. At the lower end of the cell as shown in FIG. 1 approaching the end plate 14, the concentration of the copper ion and the ion containing and conducting medium is virtually zero, depending upon the length of the cell and the flow rate.

The following data and specific examples show results obtained with an embodiment of the invention as shown in the annexed drawings and using various ion containing and conducting media. The test solutions were prepared by dissolving copper in water along with sulfuric acid and in the cases indicated with sodium sulfate. This solution was pumped through the apparatus such as shown in the annexed drawings, the temperature of the ion containing and conducting medium noted, the amperage and the time over which the current was applied. The voltage was determined and recorded.

In the course of the electrolytic reaction, using copper sulfate as the ion yielding material, copper would be deposited from the cathode as small particles of copper powder, a substantial portion of which remains suspended in the ion containing and conducting medium as free metal. Some of the copper, however, adhered to the electrode or became trapped within the structure. In order to remove this electrode deposited copper, a solution of $NH_4CO_3.NH_4$ was circulated through the cell to dissolve metallic copper. Since this copper has also been recovered by electrochemical reaction from the solution, it was determined and added to the quantity of metallic copper separated from the spent ion containing and conducting medium.

The following table tabulates the results of tests carried out under varying conditions and with varying amounts of copper in the ion containing and conducting medium at the start. The "total Cu" is the summation of the amount of copper powder collected in grams and the amount of copper recovered from the $NH_4CO_3.NH_4$ solution in grams.

The axial flow cell used in the following tests included nine cathode plates and eight anode plates. The cell body was formed of 2 inch internal diameter by ⅛ inch wall Plexiglass tube with slots milled for the electrode peripheries and holes drilled for the terminals. The end caps were formed of ½ inch Plexiglass with an annular groove for the end of the conduit and sealing ring and drilled and tapped for ½ inch pipe in the center thereof. The bus bars were formed of copper and suitably drilled to receive the electrode terminals. The anodes were formed of expanded titanium. The cathodes were formed of perforated titanium punched and ground to the proper size and having titanium terminals. The cell was approximately 10 inches between end caps, and the electrodes were spaced ½ inch apart alternating cathode-anode-cathode, etc. and terminating with a cathode.

The present cell has also been used to recover copper from aqueous acid leach solutions of copper ore containing copper in very low concentration, e.g. from about 0.1 to about 2 grams per liter. In such a case, the ore which is at approximately 325 mesh is slurried with the acid leach composition, and the slurry pumped through the axial flow cell of the present invention. Under suitable current density conditions such as those set forth in the following table, dendrites of copper metal will be formed on the cathodes. These can easily be dislodged and recovered.

In order to facilitate recovery of material such as copper dendrites adhering to the electrodes, it is contemplated that the cell shall be divisible into halves and held together by suitable clamps and seals. When it is desired, then, to clean the electrodes, the half shells may be separated, and the electrodes exposed for removal of the deposited dendrites of metal. The electrode spacing ranges from 0.25 to 1 inch and the voltage at which the cell is operated is generally from about 2 to about 10 volts.

TABLE I

| RUN NO. | ION CONTAINING & COND. $H_2SO_4$ | Fe | $Na_2SO_4$ | MEDIUM COMP. Cu gm/l Start | Finish | FLOW RATE gpm | C.D. asf | AMP. HRS. | TOTAL Cu gms. | CATHODE EFF % | RISE TEMP °C. | MAT. BAL. % * |
|---|---|---|---|---|---|---|---|---|---|---|---|---|
| 1 | 5 | 0 | 15 | 0.195 | 0.170 | 4.6 | 100 | 50 | 1.6 | 2.6 | 2 | 75.6 |
| 2 | 5 | 0 | 15 | 0.195 | 0.141 | 6.9 | 100 | 50 | 4.7 | 8.1 | 2 | 87.8 |
| 3 | 5 | 0 | 15 | 0.192 | 0.130 | 9.2 | 100 | 50 | 6.3 | 10.6 | — | 101.0 |
| 4 | 5 | 0 | 15 | 0.292 | 0.085 | 9.2 | 200 | 170 | 21.5 | 10.7 | 8.5 | 103.9 |
| 5 | 5 | 0 | 15 | 0.288 | 0.157 | 9.2 | 200 | 85 | 9.8 | 9.8 | 5.5 | 75.0 |
| 6 | 5 | 0 | 15 | 0.296 | 0.073 | 9.2 | 50 | 47.5 | 19.7 | 35 | 1.0 | 88.5 |
| 7 | 5 | 0 | 15 | 0.294 | 0.235 | 9.2 | 100 | 25 | 4.6 | 16 | — | 77.2 |
| 8 | 5 | 5 | 0 | 0.291 | 0.117 | 9.2 | 50 | 47.5 | 14.7 | 27 | 0 | 98.9 |
| 9 | 5 | 0 | 15 | 0.278 | 0.053 | 9.2 | 50 | 50 | 22.9 | 45 | — | 101.9** |
| 10 | 5 | 5 | 0 | 1.890 | 1.430 | 9.2 | 100 | 41.7 | 52.7 | 90 | 2.0 | 114.6 |
| 11 | 5 | 5 | 0 | 1.890 | 1.510 | 9.2 | 200 | 100 | 34.6 | 70 | — | 91.0 |
| 12 | 5 | 5 | 0 | 0.969 | 0.750 | 9.2 | 50 | 21 | 23.7 | 96 | — | 100.7 |
| 13 | 5 | 5 | 0 | 1.120 | 0.921 | 9.2 | 100 | 21 | 16.3 | 66 | 1.0 | 82.1 |
| 14 | 5 | 0 | 15 | 0.950 | 0.789 | 9.2 | 100 | 21 | 15.7 | 63.5 | 1.0 | 97.7 |

*Material Balance % = $100 \times \frac{\text{gms Cu Powder + gms Cu leached}}{\text{Total Cu in soln.}}$

**Based on Cu Powder recovered alone

A typical composition for the ion containing and conducting medium for recovery of copper at low concentrations is as follows:

| | |
|---|---|
| $CuSO_4$ | 0.1 to 2.0 gms/liter as Cu |
| $H_2SO_4$ | 5 gms/liter |
| $Na_2SO_4$ | 0 to 15 gms/liter |
| $Fe_2(SO_4)_3$ | 5 gms/liter |
| Water | to one liter |

Typical conditions for electrolysis in the specific apparatus above described are as follows:

| | |
|---|---|
| Current density | 25 - 400 ASF |
| Temperature | 20 - 30°C. |
| Flow rate | 4.6 to 9.2 gal./min.<br>30 to 50 ft./min. |
| Anodes | DSA |
| Cathode | Titanium, or stainless steel |

Figure 8:
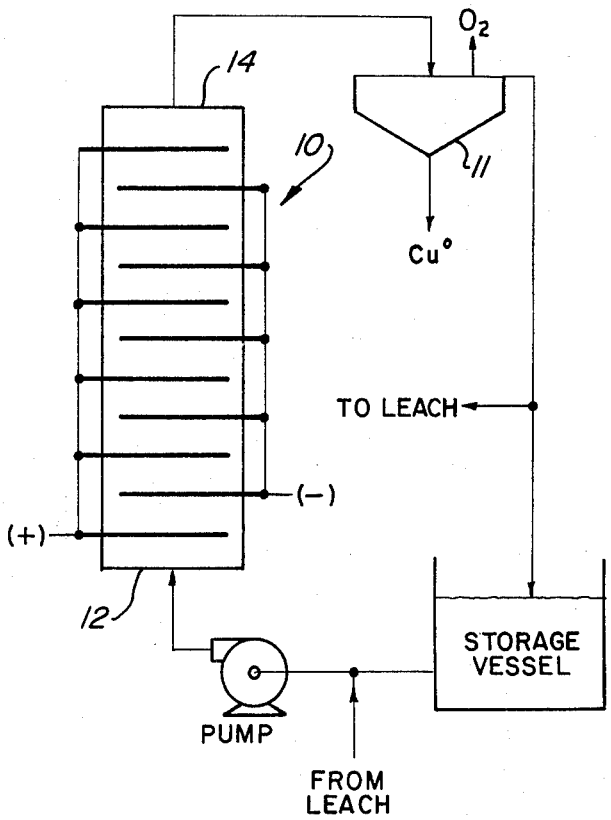
FIG. 8 is a schematic diagram of a copper recovery system utilizing an axial flow electrolytic cell in accordance with this invention.

In operation, copper forms as a powder on the cell cathodes. It sloughs off and is carried through the outlet end 14 with the copper depleted ion containing and conducting medium and collected in a thickener (see FIG. 8). Overflow from the thickener 11 may be recycled or directed to the leach bed and ultimately returned to the system for passage through the axial flow cell 10 diagrammatically shown in FIG. 8. Oxygen gas also disengages in the thickener and is available for recovery.

Figure 6:
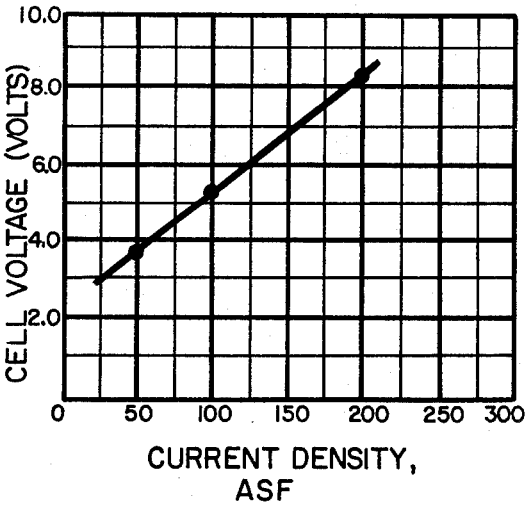
FIG. 6 is a graph showing the relationship of cell voltage to current density.
Figure 7:
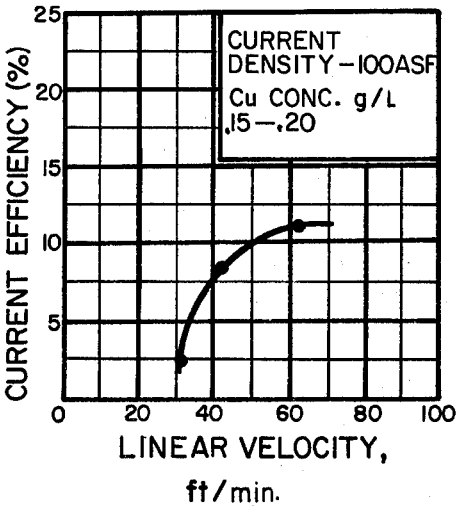
FIG. 7 is a graph showing the effect of flow rate on current efficiency at very low copper concentration.

Experimental results are tabulated in Table I above. FIG. 5 illustrates the inter-relationship of copper concentration, current density and current efficiency. In calculating the copper concentration for plotting the points in FIG. 5, the average between the inlet copper concentration and the outlet concentration was used. FIG. 6 shows the current density-cell voltage relationship. The effect of flow rate on current efficiency at very low copper concentrations is shown in FIG. 7.

In conventional copper electrowinning current densities are normally 15–25 amperes/sq ft at copper concentrations of 30–45 g/l. The ratio of ASF to Cu is limited to 0.5 to 1.0 over a wide range of copper concentrations.

Techniques such as directed flow of electrolyte, air sparging, ultrasonic agitation, and mechanical wiping have all been used to increase the copper mass transport and thereby permit higher current densities. ASF-:Cu ratios as high as 2–7 have been achieved.

Copper powder has been produced in the axial flow cell at ASF ratios in the range of 50–70. This ratio is of significance in the field of copper electrowinning. As will be noted in the following Table II in the electrowinning of conventional copper per liter, the normal ASF-/Cu ratio is 0.5 to 1. New techniques have improved the ratio by a factor of up to 7. In the case of the very low concentrations we are able to use, we are able to realize ratios of up to 100 times those conventionally obtained and from 7 to 10 times those of improved techniques.

TABLE II

| | Copper Electrolysis Conditions Cu g/l | $H_2SO_4$ g/l | Current Density amp/ft² | ASF/Cu |
|---|---|---|---|---|
| Conventional | 30 - 50 | 150–300 | 15 - 25 | 0.5 - 1.0 |
| New techniques | 30 - 50 | 150–300 | 30 - 300 | 1.0 - 7.0 |
| Axial flow | 0.2–2.0 | 5.0 | 50 - 200 | 50 - 70 |

The axial flow cell design does not permit the convenient installation of a membrane or diaphragm therefore it's principal application will be in those situations where one-compartment cells are satisfactory. There are several of those applications in the minerals industry and also in the industrial chemicals industry. These are tabulated in Table III.

TABLE III

| Process Application | Electrolyte System |
|---|---|
| Copper powder recovery | Heap or dump leach liquors from copper oxide. Electrolyte strip liquors.<br>Slurry electrolysis of mixed oxide and sulfide copper. |
| Electrooxidation | Ore slurry and brine for recovery of silver, gold, molybdenum, rhenium, lead-zinc, and mercury. |
| Hypochlorite generation | Sea water treatment.<br>Sewage treatment. |

TABLE III-continued

| Process Application | Electrolyte System |
|---|---|
| Sodium chlorate production | Sodium chloride brine. |
| Sodium perchlorate production | Sodium chlorate brine. |

What is claimed is:

1. An axial flow electrolytic cell comprising in combination:
   a. an electrically nonconductive completely closed conduit;
   b. end closures for each end of said conduit each of said end closures having an opening therethrough for passage of an ion-containing and conducting medium;
   c. a plurality of electrodes in axially spaced relation and transversely disposed across said tubular conduit, each of said electrodes having macro openings extending therethrough;
   d. first bus bar means electrically connecting alternate ones of said electrodes; and
   e. second bus bar means isolated from said first bus bar means electrically connecting the remaining electrodes.

2. An axial flow electrolytic cell in accordance with claim 1 in which the conduit is a rigid straight tube.

3. An axial flow electrolytic cell in accordance with claim 2 in which the tubular conduit has a circular cross section.

4. An axial flow electrolytic cell in accordance with claim 1 in which the end closures are formed of electrically nonconductive material.

5. An axial flow electrolytic cell in accordance with claim 1 in which the electrodes are in substantial peripheral engagement with the side walls of said conduit.

6. An axial flow electrolytic cell in accordance with claim 1 in which the electrodes are axially spaced at regular intervals.

7. An axial flow electrolytic cell in accordance with claim 1 in which the electrodes are nonconsumable.

8. An axial flow electrolytic cell in accordance with claim 7 in which the electrodes are expanded metal plates.

9. An axial flow electrolytic cell in accordance with claim 8 in which the electrodes are of titanium metal.

10. An axial flow electrolytic cell in accordance with claim 5 in which the electrodes are each provided with terminal means projecting therefrom for extension through the conduit wall.

11. An axial flow electrolytic cell in accordance with claim 1 in which the first and second bus bar means are each disposed externally of the tubular conduit.

12. An axial flow electrolytic cell in accordance with claim 8 in which the ratio of the effective surface area of the electrodes to the cross sectional area is at least 0.8 to 1.

13. An axial flow electrolytic cell in which an ion-containing and conducting medium flows axially through perforated electrodes of alternating polarity at flow rates productive of turbulent flow and comprising in combination:
   a. a rigid, electrically nonconductive tube of uniform circular cross-section;
   b. electrically nonconductive end closures for each end of said tube, each of said end closures having an opening therethrough for passage of an ion-containing and conducting medium;
   c. a plurality of circular expanded metal electrodes of one sign in axial spaced relation and circumferentially engaging the side wall of said tube, each of said electrodes of said one sign having terminal means of the one sign radially extending therefrom and projecting through the wall of said conduit;
   d. a first bus bar external of said tube and electrically connecting all of said terminal means of the one sign;
   e. a plurality of circular expanded metal electrodes of the opposite sign in axially spaced and alternating relation with said electrodes of the one sign, said electrodes of the opposite sign also circumferentially engaging the side wall of said tube and having terminal means of the opposite sign radially extending therefrom and projecting through the wall of said tube; and
   f. a second bus bar electrically isolated from said first bus bar, external of said tube and electrically connecting all of said terminal means of said opposite sign.

14. An axial flow electrolytic cell in which high current densities can be obtained with low metal concentration electrolytes, comprising: a closed channel of dielectric material forming the cell body, sealing means for sealing the ends of said closed channel to provide a completely sealed cell body, a liquid inlet channel in one of said sealing means and a liquid outlet channel in the other of said sealing means, perforate axially-spaced electrodes in said channel supported in an orientation substantially perpendicular to the long axis of said chennel, said electrodes being dimensioned so that their peripheries extend substantially to the internal periphery of said closed channel, means for spacing said electrodes, an electrical terminal for each electrode connected to the electrode and extending through the wall of said channel, the openings in the wall of said closed channel through which said terminals extend being sealed against leakage of fluids, first and second spaced-apart longitudinal bus bars lying along the outside of said closed channel, the electrical terminals for alternate electrodes being connected to said first bus bar and the electrical terminals of the remaining electrodes being connected to said second bus bar, said bus bars being connected, respectively, to positive and negative sources of electricity so that alternate electrodes are, respectively, anodes and cathodes, whereby the electrolytic cell which is formed by the recited structure is completely sealed against the escape of liquids and gases from the cell body except at the inlet and outlet channels.

15. The electrolytic cell of claim 14 in which said closed channel is substantially circular and said bus bars are substantially 180° apart.

16. The electrolytic cell of claim 14 in which said spacing means are spacing collars of dielectric material between the electrodes peripherially abutting the internal surface of said closed channel and closely abutting adjacent electrodes.

* * * * *